US005150489A

United States Patent [19]

Kaji et al.

[11] Patent Number: 5,150,489

[45] Date of Patent: Sep. 29, 1992

[54] APPARATUS AND METHOD FOR CONTROLLING A WASHING MACHINE

[75] Inventors: Shinichi Kaji, Katsuta; Kazuyuki Yano, Hitachi; Yoshitaka Shibata, Hitachi; Toshihiro Takahashi, Hitachi; Kiyomi Takamaru, Hitachi; Hideyuki Tobita, Hitachi; Isao Hiyama, Hitachi, all of Japan

[73] Assignee: Hitachi, Ltd., Tokyo, Japan

[21] Appl. No.: 660,885

[22] Filed: Feb. 26, 1991

[30] Foreign Application Priority Data

Mar. 9, 1990 [JP] Japan ..... 2-056375

[51] Int. Cl.[5] ..... D06F 33/02

[52] U.S. Cl. ..... 8/159; 68/12.01; 68/12.14; 68/12.16; 68/12.23

[58] Field of Search ..... 8/158, 159; 68/12.01, 68/12.14, 12.16, 12.23; 134/57 D, 58 D

[56] References Cited

U.S. PATENT DOCUMENTS

| | | | |
|---|---|---|---|
| 4,237,565 | 12/1980 | Torita et al. . | |
| 4,449,384 | 5/1984 | Jones . | |
| 4,468,600 | 8/1984 | Barthel et al. | 134/58 X |
| 4,510,778 | 4/1985 | Cotton . | |
| 4,679,414 | 7/1987 | Takimoto et al. . | |
| 4,843,671 | 7/1989 | Hirooka et al. | 68/12.14 X |
| 5,012,658 | 5/1991 | Shikamori et al. | 68/12.01 |

FOREIGN PATENT DOCUMENTS

| | | | |
|---|---|---|---|
| 31697/89 | 3/1989 | Australia . | |
| 35818/89 | 5/1989 | Australia . | |
| 994894 | 8/1976 | Canada | 68/12.23 |
| 55-19130 | 2/1980 | Japan . | |
| 55-106196 | 8/1980 | Japan . | |
| 56-102290 | 8/1981 | Japan . | |
| 58-105793 | 6/1983 | Japan . | |
| 61-238294 | 10/1986 | Japan . | |
| 62-38198 | 2/1987 | Japan . | |

*Primary Examiner*—Philip R. Coe

*Attorney, Agent, or Firm*—Antonelli, Terry, Stout & Kraus

[57] ABSTRACT

An apparatus and a method for controlling a washing machine. The washing machine control apparatus includes a mechanical timer and a controller including a microcomputer. The mechanical timer has a plurality of cam switches for controlling the steps of washing, rinsing and dehydrating by the washing machine, and the cam switches are actuated so as to open and close a feed water valve and a drain valve and to instruct the control to drive a drive motor according to a selected operation pattern. The controller controls the drive motor and drives a washing tube through an agitating member and includes a memory for storing a plurality of motor operation patterns corresponding to the washing, rinsing and dehydrating steps, so that the drive motor is driven according to an operation pattern controlled by the mechanical timer and stored in the memory of the controller.

11 Claims, 6 Drawing Sheets

FIG. 4

| INPUT | STEP | NAMES OF WATER FLOW AND DEHYDRATION | CONTROL PATTERN |
|---|---|---|---|
| A | WASH RINSE | STANDARD WATER FLOW | CONTINUOUS NORMAL AND REVERSE ROTATION WITH 0.8 "ON, 0.2" OFF |
| D | | SOFT WATER FLOW | CONTINUOUS NORMAL AND REVERSE ROTATION WITH 0.3 "ON, 1.0" OFF |
| C | | BALANCED WATER FLOW | CONTINUOUS NORMAL AND REVERSE ROTATION WITH 0.3 "ON, 0.3 OFF |
| B | DEHYDRATE | INTERMITTENT DEHYDRATION | CONTINUOUS NORMAL ROTATION, AFTER 12 TIMES UNIDIRECTIONAL ROTATION WITH 4" ON, 6" OFF |
| B, C | | CONTINUOUS DEHYDRATION | CONTINUOUS NORMAL ROTATION |

APPARATUS AND METHOD FOR CONTROLLING A WASHING MACHINE

BACKGROUND OF THE INVENTION

This invention relates to an apparatus and method for controlling a washing machine. More particularly, this invention relates to a washing machine control apparatus using an combination of a timer automatically controlling the steps of washing, rinsing and dehydrating by a washing machine and a control circuit controlling a drive motor, and relates also to method for controlling the washing machine.

A mechanical timer was used hitherto so as to control the washing, rinsing, dehydrating and other operations of a washing machine, and these operations of the washing machine were sequentially controlled by cam switches actuated by the operation of the timer.

JP-A-55-19130, JP-A-55-106196, etc. propose improvements in which such a mechanical timer is replaced by a microcomputer as so to attain a higher grade control for the washing machine. Also, JP-A-56-102290 proposes a washing machine control apparatus in which a controller is used so as to change the operating speed of the mechanical timer.

Further, JP-A-58-105793 proposes another washing machine control apparatus. In this washing machine control apparatus, a semiconductor switch, which is connected in series with a timer having a contact turned on by manual setting and an associated timing cam, is used to control a drive motor. This semiconductor switch operates in accordance with the period of oscillation of an oscillation circuit.

It is a common practice in a washing machine that its drive motor is turned on-off or rotated in normal and reverse directions as to adjust the flow of water. Therefore, in order to more finely adjust the flow of water, it is necessary to turn on-off the drive motor with shortened on-off timing.

In the case of the related art washing machine using the mechanical timer, an attempt to attain the fine adjustment of the flow of water by increasing the number of the cam switches in the timer thereby turning on-off the drive motor with shortened on-off timing cannot achieve the desired accuracy of on-off timing. Therefore, it is difficult to attain the desired fine adjustment of the flow of water. Further, the shortened timing of turning on-off the cam switches may lower the reliability of contact arms and contacts of the cam switches. Also, each time the cam switches are turned on-off, undesirable switch noise will be generated due to the opening and closing of the contacts.

In the related art washing machine using the microcomputer for the purpose of operation control, a control circuit as shown in FIG. 6 is employed. In the control circuit shown in FIG. 6, a control circuit board 67 provided for controlling the washing machine is normally kept connected to a power source unless a power supply switch 64 is turned off, and this arrangement leads to the possibility of mis-operation due to, for example, external noise. Also, the above arrangement has such another problem that, once the mis-operation takes place, the control circuit will not be reset unless the power supply switch 64 is turned off.

Also, in the washing machine control apparatus disclosed in JP-A-58-105793, no consideration is given for the combination of the timer and a control circuit for controlling the series of the steps of washing, rinsing and dehydrating. Thus, the disclosed control apparatus is defective in that the operation of the drive motor cannot be finely controlled for each of the individual steps.

SUMMARY OF THE INVENTION

It is an object of the present invention to provide a washing machine control apparatus in which a control circuit including a commanding control circuit in the form of a microcomputer identifies input signals from a plurality of cam switches in a timer so as to finely control the on-off timing of a washing machine drive motor in each of the steps of washing, rinsing and dehydrating, thereby highly accurately controlling the washing, rinsing and dehydrating operations of the washing machine.

Another object of the present invention is to provide a washing machine control apparatus in which a mechanical timer is used so that the washing machine can be simply operated.

Still another object of the present invention is to provide a highly reliable washing machine in which a microcomputer is used to turn on-off its drive motor.

According to one aspect of the present invention which attains the above objects, there is provided an apparatus for controlling a washing machine comprising a mechanical timer including a plurality of cam switches for controlling the steps of washing, rinsing and dehydrating by the washing machine and a control circuit including commanding control means in the form of a microcomputer, the plural cam switches incorporated in the timer controlling the operation sequence and operation timing of the washing, rinsing and dehydrating steps of the washing machine and also controlling electrical parts, except a drive motor to be controlled in each of the individual steps, and the commanding control means in the form of the microcomputer identifying input signals from the plural cam switches incorporated in the timer so as to control the on-off timing of the drive motor by the control circuit.

According to another aspect of the present invention, there is provided an apparatus for controlling a washing machine which includes various loads including a washing tub, an agitating member rotatably disposed in the washing tub, a drive motor for rotating the agitating member, a feed water valve for feeding water into the washing tub, and a drain valve for draining water from the washing tub, the control apparatus comprising a mechanical timer and a control circuit including a controller to control the operation of the various loads, the mechanical timer generating output signals for controlling the operation of the various loads except the drive motor, and the controlled means including memory means storing various data patterns of operation of the drive motor thereby controlling the operation of the drive motor according to the data operation patterns stored in the memory means.

According to still another aspect of the present invention, there is provided an apparatus for controlling a washing machine which includes a washing and dehydrating tub, an agitating member rotatably disposed in the washing and dehydrating tub, and a drive motor for driving both of the agitating member and the washing and dehydrating tub, the control apparatus comprising a control circuit including commanding control means including memory means for storing various patterns of operation of the drive motor, and a drive circuit for turning on-off the load current of the drive motor according to the operation patterns stored in the memory means.

According to yet another aspect of the present invention, there is provided an apparatus for controlling a washing machine comprising feed water valve control including a feed water valve means for controlling the opening closing of a feed water valve feeding water into a washing tub, drain valve control means includes a drain valve for controlling the opening and closing of the drain valve draining water from the washing tub, a mechanical timer having a plurality of cam switches for controlling the steps of washing, rinsing and dehydrating, the cam switches of the timer being actuated so as to operate the feed water valve control means and the drain valve control means and so as to instruct a control circuit to drive a drive motor according to a selected operation pattern, and a control circuit including memory means for storing a plurality of patterns of operation of the drive motor driving the washing tub and an agitating member so as to control the drive motor to operate according to a selected operation pattern, wherein the control circuit drives the drive motor according to the operation pattern instructed by the mechanical timer.

According to a further aspect of the present invention, there is provided a method for controlling a washing machine comprising the steps of selectively actuating cam switches in a mechanical timer for opening and closing a feed water valve feeding water into a washing tub, and opening and closing a drain valve draining water from the washing tub, instructing a control circuit so as to drive a drive motor according to a selected operation pattern, and driving the drive motor driving the washing tub and/or an agitating member by the control circuit according to the operation pattern instructed by the timer cam switches and stored in memory means in the control circuit.

BRIEF DESCRIPTION OF THE DRAWINGS

These and other objects and advantages of the present invention will become apparent by reference to the following description and accompanying drawings, wherein:

FIG. 4 is a table showing the classification of water flow and dehydration controlled by the microcomputer used in the washing machine control apparatus of the present invention;

DESCRIPTION OF THE PREFERRED EMBODIMENTS

Preferred embodiments of the washing machine control apparatus according to the present invention will now be described in detail by reference to the drawings.

Figure 5:
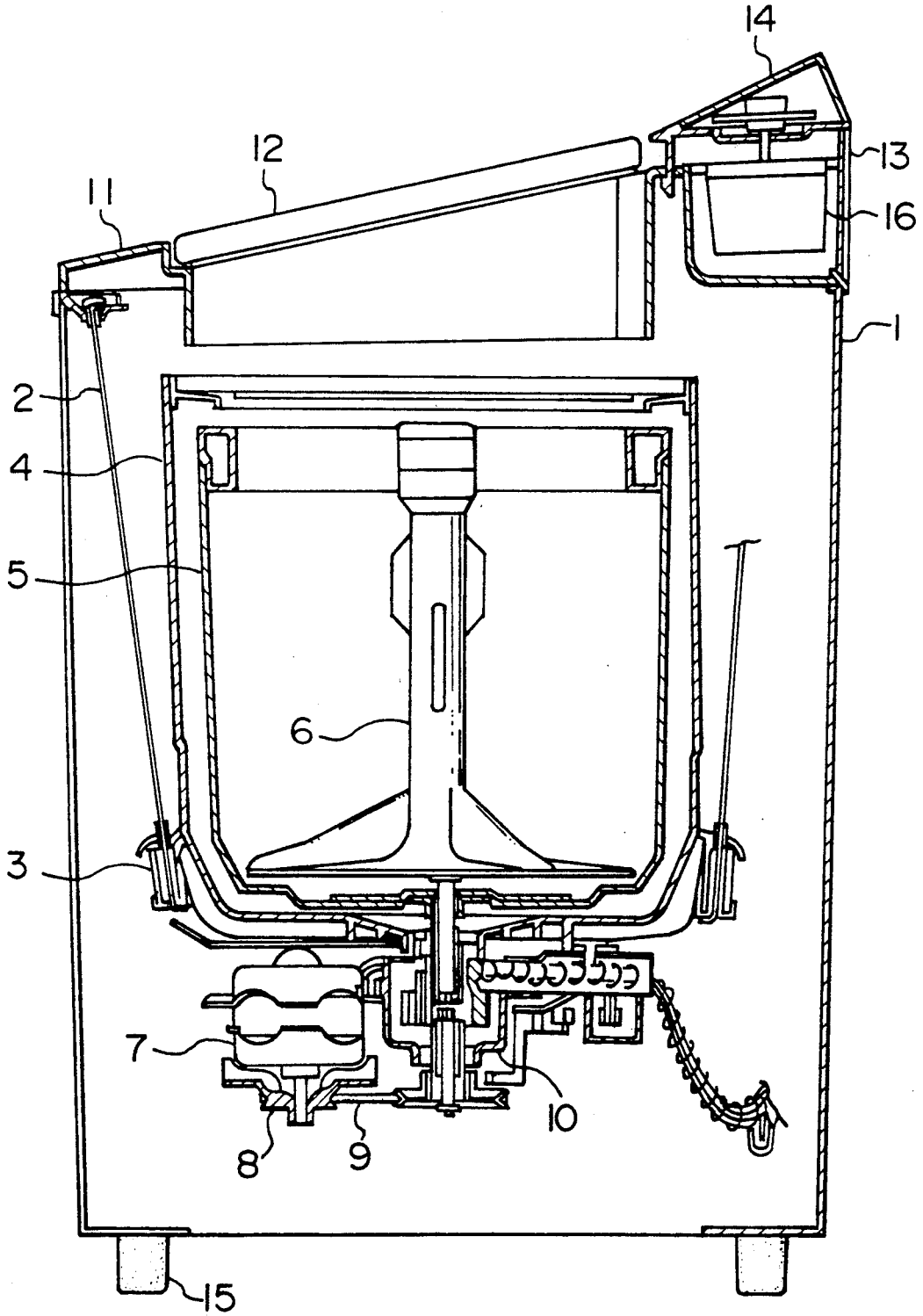
FIG. 5 is a partly sectional, side elevational view of the washing machine controlled by the apparatus of the present invention.

A washing machine controlled by an embodiment of the control apparatus according to the present invention has a mechanical construction as shown in FIG. 5.

Referring to FIG. 5, the washing machine includes an outer cabinet 1 of a rectangular sectional shape formed by a steel plate. An outer tub 4 of a synthetic resin is suspended from the upper four corners of the outer cabinet 1 by four steel rods 2 through springs 3 of a steel sheet. A washing and dehydrating tub 5 of a synthetic resin is rotatably disposed inside the outer tub 4, and a agitator 6 is rotatably mounted at the center of the washing and dehydrating tub 5. A capacitor-start induction motor 7 having a covering of a steel plate is mounted on a base of a steel plate fixed to the outer bottom of the outer tub 4. The washing and dehydrating tub 5 is driven by the induction motor 7 through a pulley 8, a belt 9 and a clutch unit 10 so as to make washing, rinsing and dehydrating operations. That is, the washing, rinsing and dehydrating operations are carried out by driving the tub 5 by the single motor 7 while engaging and disengaging the clutch unit 10.

A top cover 11 of a synthetic resin is fixed by screws to cover the top of the outer cabinet 1 and has a central opening. A lid 12 of a synthetic resin opens and closes to undercover and cover the central opening of the top cover 11.

Behind the top cover 11, a back panel 13 is fixed to the outer cabinet 1 by clamps and screws. The back panel 13 has a central recess to accommodate a display device and a switch device and is covered with a switch cover 14 of a semitransparent thermoplastic resin. The outer cabinet 1 of the washing machine is supported on stationary legs 15. A timer 16 and a control circuit 17 including a commanding control unit in the form of a microcomputer, both of which are essential parts of the control apparatus of the present invention, are fixed to the back panel 13 with screws.

An embodiment of the control apparatus and the control method for controlling the washing machine having the mechanical construction shown in FIG. 5 will now be described in detail by reference to FIGS. 1 to 4.

Figure 1:
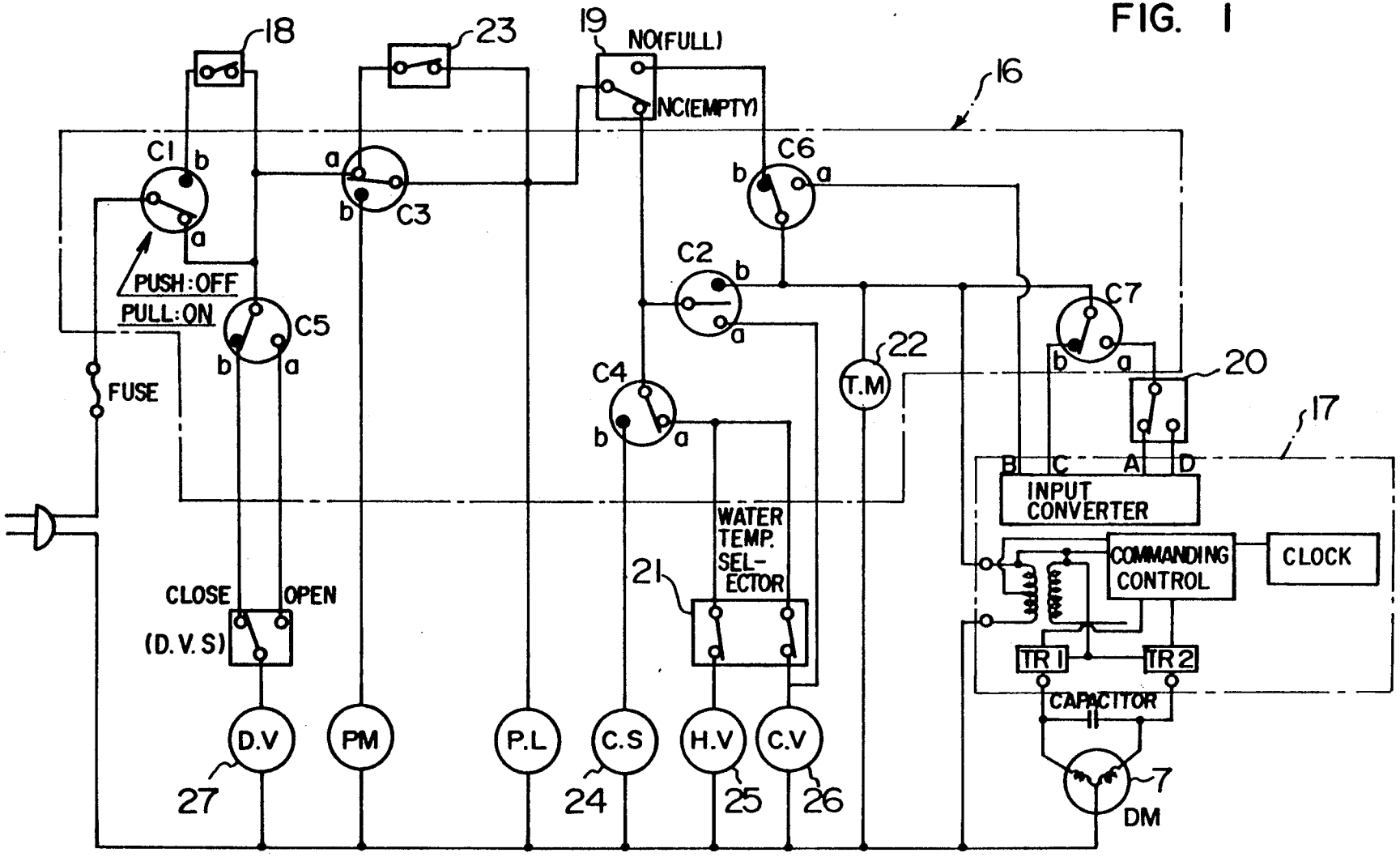
FIG. 1 is a circuit diagram of an embodiment of the washing machine control apparatus according to the present invention.
Figure 2:
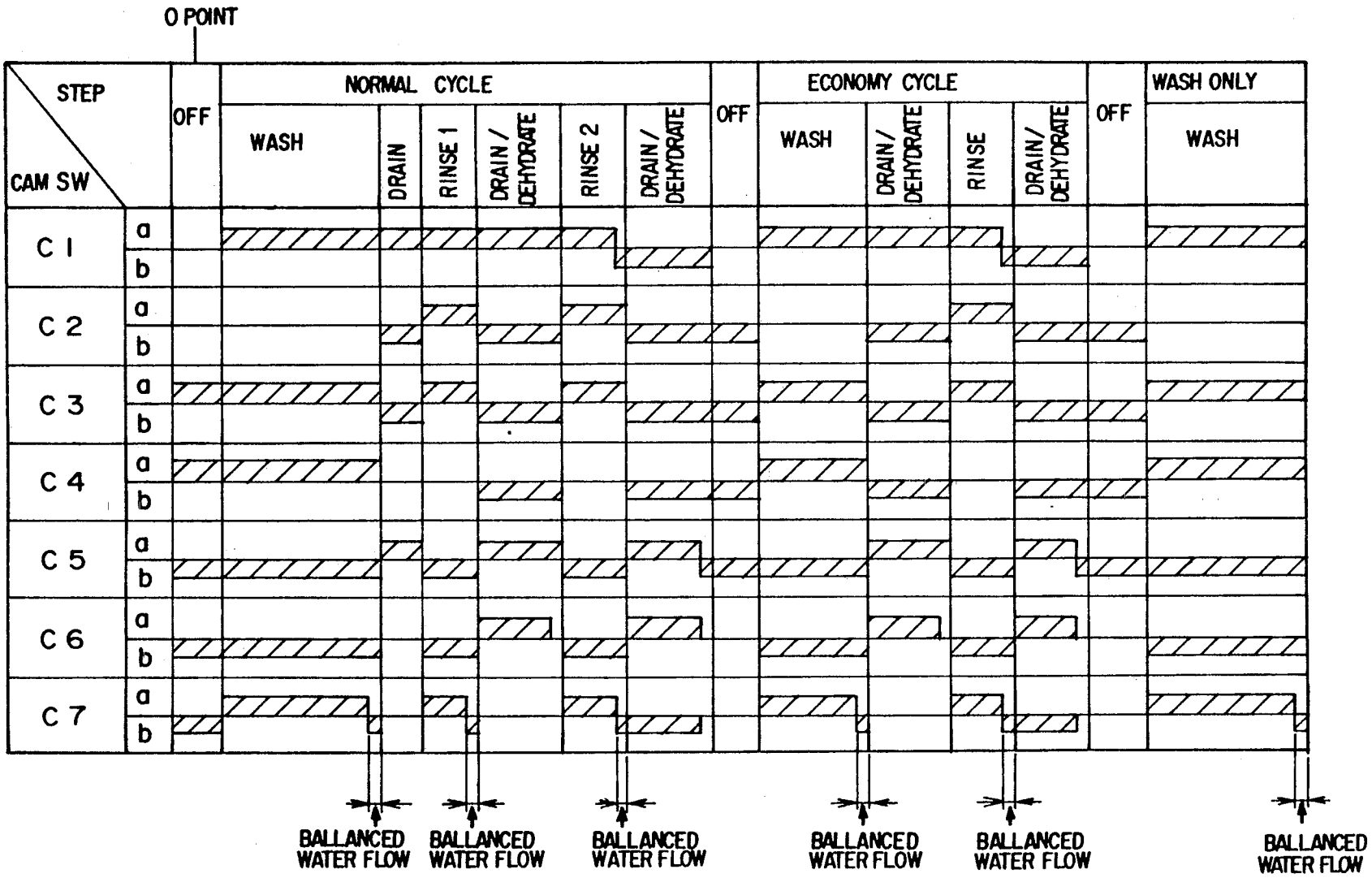
FIG. 2 is a chart showing the operation cycle and operation timing of the timer used in the washing machine control apparatus according to the present invention shown in FIG. 1.

FIG. 1 is a circuit diagram of the embodiment of the control apparatus controlling the washing machine shown in FIG. 5, and FIG. 2 is a chart showing the operation cycle and operation timing of the timer 16 shown in FIG. 1.

The timer 16 used in the embodiment of the control apparatus will be described first. As described in detail later, the timer 16 has a mechanical construction including a timer motor, a plurality of cams rotated by the rotation of the timer motor and a plurality of switches actuated by the rotation of the plural cams respectively. A pointer of the timer 16 is mounted on the timer 16 and the semitransparent switch cover 14 shown in FIG. 5 is installed so as to inform the user of the proceedings of washing and to specify the washing cycle. The washing machine starts to operate when this pointer is set at the start position of a desired operation cycle and the timer 16 is turned on.

As shown in FIG. 2, three cycles can be selected by the timer 16, that is, a normal cycle in which the rinsing step and the dehydrating step are repeated two times after the washing step, an economy cycle in which the rinsing step and the dehydrating step are executed only once after, the washing step, and a wash only cycle in which only the washing step is executed. Also, as shown in FIG. 2, the washing, draining, rinsing, draining and dehydrating steps are set together with their periods of time by the cam switches C1 to C7 of the timer 16, and, when the timer 16 is turned on, the specified steps are executed for the specified periods of time.

The essential parts of the control apparatus of the present invention will now be described by reference to FIG. 1. Referring to FIG. 1, a pressure switch 19 is turned on by a contact NO when the level of water in the washing machine is raised up to a full level, while it is turned off by a contact NC when the water level drops to its empty level. The reference numeral 27 designates a drain valve, (D.V). The reference symbol D.V.S. designates a drain valve switch which is closed and opened when the drain valve 27 is opened and closed respectively by a small-sized motor. The reference symbols P.M and P.L designate a drain pump motor and a pilot lamp respectively. The reference numerals 24, 25 and 26 designate a clutch solenoid (C.S), a warm water feed valve (H.V.), and a city water feed valve (C.V.) respectively.

The washing machine controlled by the control apparatus embodying the present invention is provided with, as external switches, a program cycle switch 18, a water level switch 19, a wash action switch 20 and a water temperature selector 21. When the program cycle switch 18 is actuated, a desired one of the washing→dehydrating cycle and the washing→rinsing cycle can be selected, and the use of a softening agent in the rinsing step is permitted. The water level switch 19 is actuated to set the water level in the washing machine. When the wash action switch 20 is actuated, a standard water flow or a soft water flow (a water flow selected for washing clothes of synthetic fibers) can be selected as desired. The water temperature selector 21 is actuated to permit selection of warm water or cold water to be supplied for washing or rinsing.

Referring to FIG. 1 again, a safety switch 23 turned on-off when the lid 12 of the washing machine is closed and opened respectively is provided as a safety device. When this safety switch 23 is opened, the power supply supplying power to the timer 16 and to the control circuit 17 including the microcomputer is turned off. Therefore, even when, for example, the commanding control part in the form of the microcomputer is out of control or the switching operation for driving the drive motor 7 may become abnormal, the drive motor 7 is stopped as soon as the lid 12 of the washing machine is opened, so that the hand of the user may not be entangled with and harmed by the rotating washing and dehydrating tube 5 or the rotating agitator 6.

The detailed structure of the control circuit 17 will now be described by reference to FIG. 3 which is a block diagram of the control circuit 17.

Figure 3:
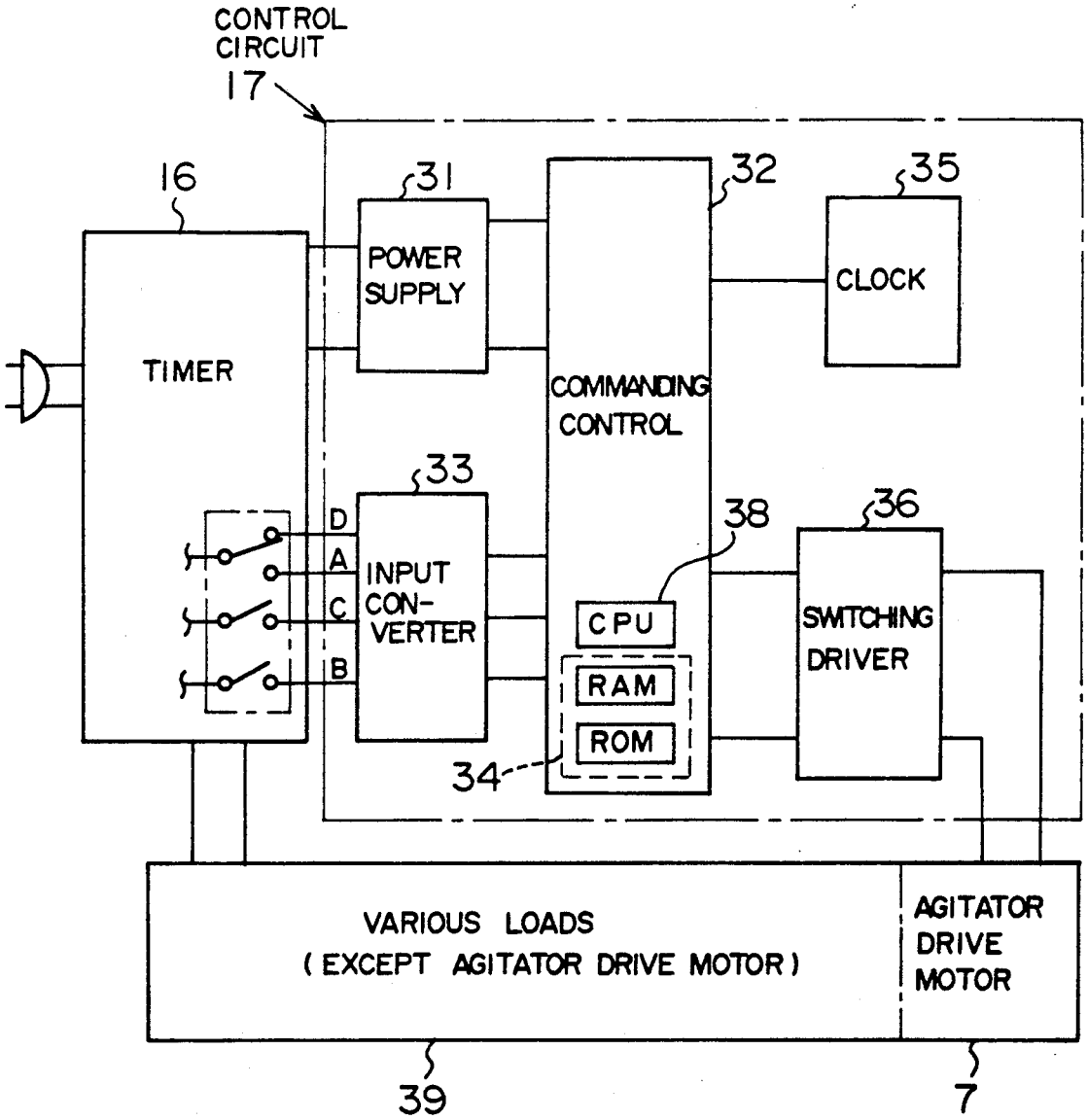
FIG. 3 is a block diagram of the control circuit used in the washing machine control apparatus of the present invention shown in FIG. 1.

Referring to FIG. 3, a power supply circuit 31 supplies required power to the timer 16 and to the commanding control unit 32, which is in the form of the microcomputer. A clock circuit 35, an input conversion circuit 33 and a switching driver circuit 36 are connected to the commanding control unit 32. This commanding control unit 32 includes a CPU 38 for carrying out the required control and a memory part 34 for storing the control patterns described already by reference to FIG. 4.

Input signals from the cam switches C6 and C7 in the timer 16 are applied to input terminals D, A, C and B of the input conversion circuit 33, and, after signal conversion in the circuit 33, these signals are applied to the commanding control unit 32. The CPU 38 in the commanding control unit 32 processes the input signals by referring to the control patterns stored in the memory part 34, and a drive signal corresponding to the input control pattern is transmitted from the CPU 38 to the switching driver circuit 36 which turns on-off the load current supplied to the drive motor 7. According to the drive signal applied to the switching driver circuit 36, the circuit 36 drives the drive motor 7.

The driving modes (the control patterns) described above will be described in further detail by reference to FIG. 4. The control circuit 17 receives inputs at its terminals A, D and C at the time of washing and rinsing. The input applied to the terminal A instructs a "standard water flow" selected in the case of usual washing. The input applied to the terminal D instructs a "soft water flow" selected in the case of washing clothes of synthetic fibers and the like. The input applied to the terminal C instructs a "balanced water flow" selected in order to prevent entanglement of clothes immediately before the end of washing. Also, the control circuit 17 receives inputs at its terminals B and C at the time of dehydration. The input applied to the terminal B instructs "intermittent dehydration" selected in order to avoid or minimize over-sudsing. The inputs applied to both the terminals B and C instruct "continuous dehydration". The control circuit 17 drives the drive motor 7 according to the control patterns instructed by these inputs.

The control operation by the control apparatus embodying the present invention will now be briefly described by reference to FIGS. 1 and 2 in the case where, for example, the economy cycle is selected.

1. Washing Step

As soon as the timer 16 is turned on, the power supply voltage is applied to the feed water valve H.V. 25 (or the feed water valve C.V. 26) through the contact a of the cam switch C1, the contact a of the cam switch C3, the contact NC of the pressure switch 19, the contact a of the cam switch C4 and the water temperature selector 21. The feed water valve H.V 25 (or C.V 26) is opened, and, while maintaining the drain valve D.V 27 in its closed position, water is fed into the washing and dehydrating tub 5. As soon as water is filled up to the water level required for washing, the contact of the pressure switch 19 is switched over to the contact NO (full) from the contact NC (empty), and the feed water valve H.V 25 (or C.V 26) is closed to end the feeding of water.

Then, the power supply voltage is applied to the timer motor T.M 22 through the contact b of the cam switch C6 to start the timing operation of the timer 16. At the same time, the voltage (the washing start signal) is applied to the terminal A or D of the control circuit 17 through the contact a of the cam switch C7 and the wash action switch 20. In response to the application of the washing start signal, the control circuit 17 drives the drive motor 7 according to the routine described above, thereby rotating the agitator 6 in normal and reverse directions with the period of a short time. That is, when the wash action switch 20 is connected to the input terminal A of the control circuit 17, the rotation of the agitating member 6 is repeated according to the control pattern for the "standard water flow" shown in FIG. 4. On the other hand, when the wash action switch 20 is connected to the terminal D of the control circuit 17, the rotation of the agitating member 6 is repeated according to the control pattern for the "soft water flow" shown in FIG. 4.

After lapse of the predetermined time setting, the cam switch C7 is now connected at its contact b to apply the signal to the terminal C of the control circuit 17, and, under control of the control circuit 17, the agitator 6 is driven according to the routine for the "balanced water flow". After lapse of the predetermined period of time of washing with the balanced water flow, the washing step is ended, and the contacts of the cam switches C2, C3, C4, C5 and C6 are switched over to prepare for the draining and dehydrating step.

2. Draining and Dehydrating Step (First)

In the first draining and dehydrating step, the contact of the cam switch C5 is switched over to the contact a to open the drain valve D.V 27 thereby starting draining of water. At this time, the contact of the cam switch C6 is switched over to the contact a from the contact b so that the power supply voltage to the timer motor T.M 22 is interrupted.

As soon as the water level in the washing and dehydrating tub 6 drops down to the drain position, the contact of the pressure switch 19 is switched over to the contact NC from the contact NO, and the power supply voltage is applied to the timer motor T.M 22 through the contact b of the cam switch C2, so that the timer 16 starts its timing operation. At the same time, the power supply voltage is applied to the clutch solenoid C.S 24 through the contact NC of the pressure switch 19 and the contact b of the cam switch C4, with the result that the clutch unit 10 is changed over or engaged so as to transmit the drive force of the drive motor 7 to the washing and dehydrating tub 5.

At the same time, the power supply voltage is applied to the terminal B of the control circuit 17 through the contact a of the cam switch C1, the safety switch 23, the contact NC of the pressure switch 19 and the contact a of the cam switch C6, so as to apply the dehydration start signal to the terminal B of the control circuit 17. In response to the application of the dehydration start signal, the control circuit 17 drives the drive motor 7 according to the control pattern for the "intermittent dehydration" shown in FIG. 4. Thus, the drive motor 7 is intermittently driven in one direction in the initial stage of the dehydrating step. When the lid 12 of the washing machine is opened in the course of the dehydrating operation, the safety switch 23 is opened to interrupt the supply of the power supply voltage thereby stopping the motor 7.

After lapse of the predetermined time setting for the dehydrating step, the contacts of the cam switches C2, C3, C5, C6 and C7 are switched over to prepare for the rinsing step.

3. Rinsing Step

The operation carried out in this rinsing step is generally similar to that in the aforementioned washing step.

4. Draining and Dehydrating Step (Final)

The operation in this final draining and dehydrating step is also generally similar to that in the aforementioned first draining and dehydrating step. The difference is that, before the end of this final draining and dehydrating step, the contact of the cam switch C7 is switched over to the contact b from the contact a, and the input signal is applied also to the terminal C of the control circuit 17. Thus, the control circuit 17 receives the signals at both of its input terminals B and C, and the "continuous dehydration" shown in FIG. 4 is carried out.

Figure 6:
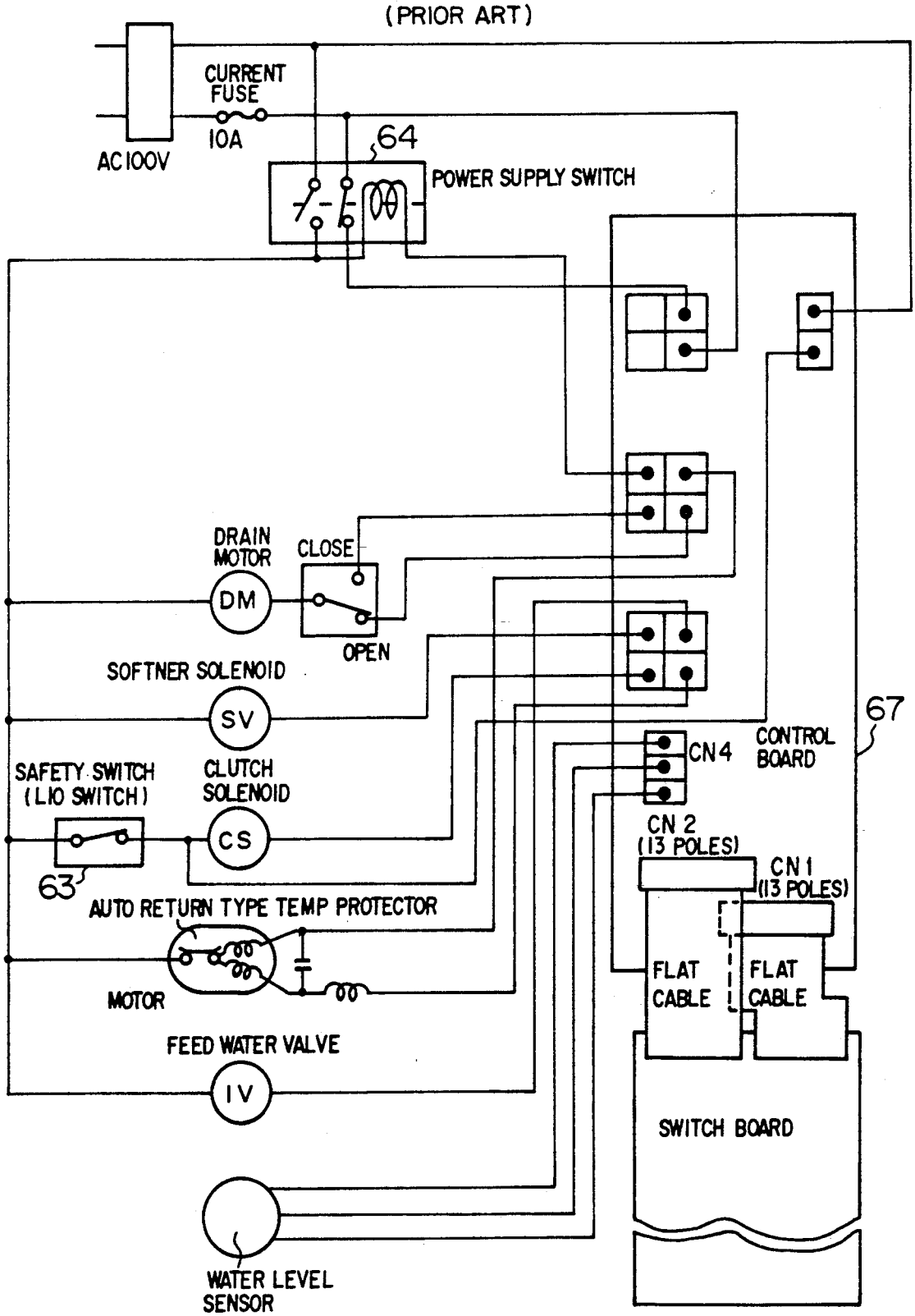
FIG. 6 (PRIOR ART)
FIG. 6 is a circuit diagram of a prior art washing machine control apparatus controlling the washing operation by a microcomputer only.

The control apparatus embodying the present invention can provide reliability higher than that of a prior art control apparatus in which a microcomputer only is used for the purpose of control. That is, in the case of the prior art control circuit shown in FIG. 6, the control circuit board 67 controlling the washing machine proper is kept connected to the power source unless the power supply switch 64 is turned off. In contrast, in the case of the embodiment of the present invention, the control circuit 17 including the microcomputer 32 is connected in parallel with the timer motor 22 driving the mechanical timer 16, and the power supply voltage is supplied only to the control circuit 17 in the period of time in which the timer motor 22 is energized. Because of the above arrangement, the period of time of supplying the power supply voltage to the control circuit 17 can be shortened thereby enhancing the reliability of the control circuit.

Further, even when the commanding control part 32 in the form of the microcomputer may make an abnormal operation in the control apparatus embodying the present invention, the supply of the power supply voltage to the timer motor 22 is interrupted when any one of the cycles is ended or when the lid 12 of the washing machine is opened. Therefore, the commanding control part 32 is reset so that the period of continuation of such an abnormal operation can be limited to a minimum. Also, because the control circuit 17 including the commanding control part 32 in the form of the microcomputer does not require any waiting time waiting for application of an instruction input or inputs, there is no possibility of mis-operation due to, for example, external noise that may appear during the waiting time.

Further, the control circuit 17 including the commanding control part 32 in the form of the microcomputer employed in the present invention can be applied to various control modes as follows so as to improve the function of the washing machine: (1) When the timer motor 22 continues to operate over more than a predetermined period of time, the operation of the timer motor 22 is decided as abnormal, and the operation of the control circuit 17 is stopped. (2) In order to reduce the sound generated from the plunger of the clutch solenoid 24 colliding against the yoke, the clutch solenoid 24 is turned on-off at a short time interval. (3) The open timing of the warm water feed valve 25 and that of the cold water feed valve 26 are suitably controlled so as to attain washing at an adequate water temperature. (4) The output signal of the safety switch 23 is utilized for issuing an alarm when so required.

While particular embodiments of the present invention have been shown and described, it will be obvious to those skilled in the art that various changes and modifications may be made without departing from the present invention in its broader aspects.

We claim:

1. An apparatus for controlling a washing machine comprising a mechanical timer including a plurality of cam switches for controlling individual steps of washing, rinsing and dehydrating of the washing machine, a drive motor to drive the washing machine, electrical components and a control circuit including a controller, said cam switches for controlling an operation sequence and an operation timing of he individual steps of washing, rinsing and dehydrating of the washing machine and also controlling said electrical components, except said drive motor, to be controlled in each of the individual steps, and wherein said controller receives input signals from said cam switches of said mechanical timer to control the on and off timing of the drive motor.

2. A apparatus according to claim 1, wherein said mechanical timer includes a timer motor and said control circuit includes a power supply circuit connected in parallel with the timer motor for driving said mechanical timer, and wherein said timer motor and said controller of said control circuit are connected to said power supply circuit when said mechanical timer is turned on.

3. A apparatus according to claim 1, wherein said apparatus further includes a safety switch and said mechanical timer further includes a timer motor and, wherein during the dehydrating step, said timer motor of said mechanical timer and said power supply circuit of said control circuit are energized through said safety switch and at least one of said cam switches of said mechanical timer.

4. An apparatus for controlling a washing machine comprising loads including a washing tub, an agitating member rotatably disposed in the washing tub, a drive motor for rotating the agitating member, a feed water valve for feeding water into the washing tub, and a drain valve for draining the water from the washing tub, and a control apparatus including a mechanical timer and a control circuit including a controller to control an operation of the loads, wherein said mechanical timer generates output signals for controlling the operation of the loads except the drive motor; and said controller including memory means for storing data patterns of operation for the drive motor, said controller controlling the operation of the drive motor according to the data patterns stored in said memory means.

5. A washing machine control apparatus according to claim 4, wherein:

said mechanical timer includes a plurality of cam switches, each of said cam switches having a movable contact arm actuated by rotation of an associated cam, said cam switches supplying load currents to the loads except the drive motor; and wherein said controller further includes a drive circuit for turning on and off the load currents of the drive motor according to the data patterns of operation for the drive motor according to the data patterns of operation for the drive motor stored in said memory means, the output signals from said cam switches of said mechanical timer being received and processed by said controller corresponding to the data patterns of operation and actuates said drive circuit.

6. An apparatus for controlling a washing machine comprising a washing and dehydrating tub, an agitating member rotatably disposed in the washing and dehydrating tub, and a drive motor for driving both of the agitating member and the washing and dehydrating tub, a control circuit including a controller including memory means for storing data patterns of operation for the drive motor, and a drive circuit for turning on and off a load current of the drive motor according to the data patterns of operation stored in said memory means, wherein the washing machine carries out a washing step, a rinsing step and a dehydrating step, and, during the washing and rinsing steps, the drive motor is controlled by the drive circuit to repeat a short cycle including forward rotation, stopping and reverse rotation by rotating the agitating member during the forward and reverse directions at a high speed with a high frequency, and during the dehydrating step, the drive motor is controlled by the drive circuit to continuously rotate in one direction by rotating the washing and dehydrating tub in one direction at a high speed, and wherein said control circuit further includes a mechanical timer including a timer motor, a plurality of cams rotated by the rotation of said timer motor, and a plurality of switches actuated by the rotation of said cams, respectively, and wherein said switches of said mechanical timer include load current switches for turning on and off load currents of loads of the washing machine except the drive motor and signal switches for applying switching signals to controller of said control circuit.

7. An apparatus according to claim 6, wherein said apparatus further comprises a pressure switch having NO contact, a NC contact and a common contact and the washing and dehydrating tub having a drain valve and a feed water valve, said pressure switch being turned on at said NO contact of the pressure switch when a water level in the washing and dehydrating tub is at a level required for washing or rinsing and is turned on at said NC contact of the pressure switch when the water level drops to a level required for dehydration, and wherein said control circuit controls the washing or rinsing step such that, when said mechanical timer is set to start the washing step or the rinsing step by the washing machine, the feed water valve is opened to feed water into the washing and dehydrating tub while maintaining the drain valve in a closed position and while maintaining said timer motor of said mechanical timer in an off state until the water is filled up to the level required for washing or rinsing, the common contact of said pressure switch being switched over from the NC contact to the NO contact to close the feed water valve as soon as the water is filled up to the level required for washing or rinsing, said timer motor being energized as the water is filled up to the level required for washing or rinsing, and said mechanical timer setting the timing of the washing step or the rinsing step and applying a washing start signal or a rinsing start signal to said controller through the load current switches of said mechanical timer, said control circuit further including a drive circuit operating in response to said washing start signal or said rinsing start signal and being processed in said controller and generating a drive output signal to rotate the drive motor in one direction so as to rotate the washing and dehydrating tub in one direction.

8. An apparatus according to claim 7, wherein aid control circuit further includes an input conversion circuit and said apparatus further comprises a power supply circuit, and input signals of the power supply circuit applied to said control circuit through said load current switches of said mechanical timer are applied to said controller after signal conversion by said input conversion circuit.

9. A washing machine control apparatus according to claim 8, wherein an on signal is said washing, rinsing or dehydration start signal applied to said control circuit, and an off signal is an end signal.

10. An apparatus for controlling a washing machine comprising:

a washing tub having an agitating member, a feed water valve for feeding water to the washing tub and a drain valve;

feed water valve control means for controlling an opening and a closing of the feed water valve for feeding water into said washing tub;

drain valve control means for controlling the opening and closing of the drain valve for draining the water from said washing tub;

a drive motor for driving the washing tub and the agitating member;

a control circuit to control the drive motor;

a mechanical timer having a plurality of cam switches for controlling steps of washing, rinsing and dehydrating, said cam switches of said mechanical timer being actuated to operate said feed water valve control means and said drain valve control means and to control said control circuit to drive the drive motor according to a selected operation pattern; and said control circuit including memory means for storing a plurality of data patterns for operation of the drive motor for driving the washing tub and the agitating member to control said drive motor to operate according to the selected operation pattern;

wherein said control circuit controls said drive motor according to the selected operation pattern by said mechanical timer.

11. A method for controlling a washing machine comprising the steps of:

selectively actuating cam switches of a mechanical timer for opening and closing a feed water valve for feeding water into a washing tub, and opening and closing a drain valve to drain the water from the washing tub;

controlling a control circuit to drive a drive motor according to a selected operation pattern; and controlling said drive motor, the washing tub and an agitating member by said control circuit according to an operation pattern stored in memory means of said control circuit being controlled by said cam switches.

* * * * *